US006382159B1

(12) United States Patent
Shifflette

(10) Patent No.: US 6,382,159 B1
(45) Date of Patent: May 7, 2002

(54) TEMPERATURE AND PRESSURE ACTIVATED PRESSURE RELIEVING SPARK PLUG

(76) Inventor: J. Michael Shifflette, 5900 SW. 196th La., Ft. Lauderdale, FL (US) 33332

( * ) Notice: Subject to any disclaimer, the term of this patent is extended or adjusted under 35 U.S.C. 154(b) by 46 days.

(21) Appl. No.: 09/687,279

(22) Filed: Oct. 13, 2000

(51) Int. Cl.[7] ..... H01T 13/08

(52) U.S. Cl. ..... 123/169 V; 123/169 R; 313/120

(58) Field of Search ..... 123/169 V, 169 R, 123/151, 152; 313/120, 135

(56) References Cited

U.S. PATENT DOCUMENTS 4,699,096 A * 10/1987 Phillips ..... 123/169 V
5,799,634 A * 9/1998 Shifflette ..... 123/169 R
5,937,813 A * 8/1999 Shifflette ..... 123/169 V

* cited by examiner

*Primary Examiner*—John Kwon
*Assistant Examiner*—Hieu T. Vo
(74) *Attorney, Agent, or Firm*—Akerman, Senterfitt & Eidson, P.A.; Michael C. Cesarano

(57) ABSTRACT

A spark plug for venting excessive engine cylinder pressure may be either pressure or temperature activated. A vent passage is created in a conventional spark plug by drilling an air vent through the housing of a conventional spark plug to a point that experiences cylinder pressures. The air vent is then sealed with a mechanical element of known structural strength and temperature response. Upon the development of excessive engine temperature, cylinder pressure, or both, the sealing element gives way, generating an air passage from the combustion chamber to the atmosphere through which cylinder pressure is vented. By venting excessive pressure, the disastrous effects of detonation, hydrolock, and other deleterious engine conditions may be avoided. Prior to the failure of the seal, the spark plug functions identically to a conventional spark plug.

15 Claims, 4 Drawing Sheets

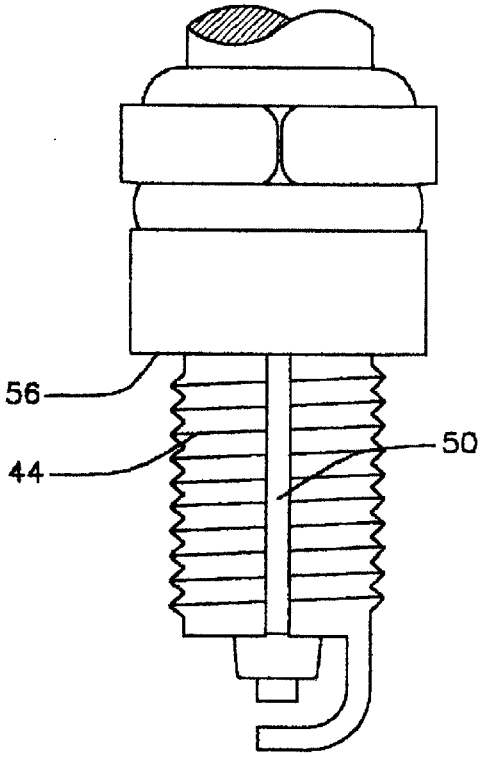
FIG. 9a
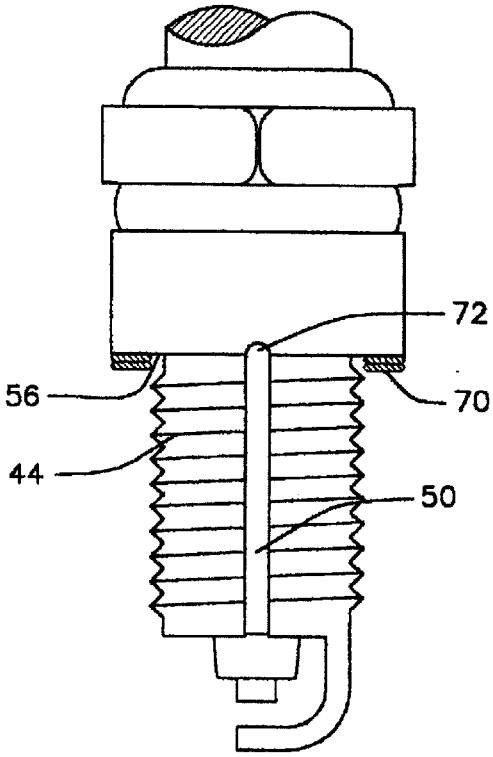
FIG. 10a
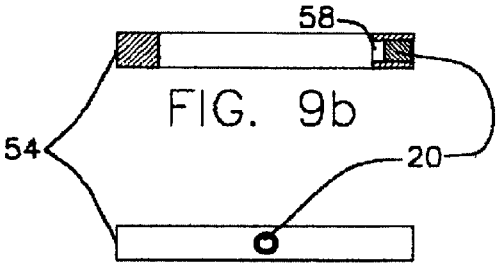
FIG. 9b
FIG. 9c
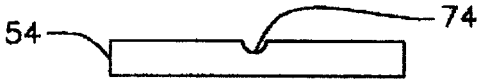
FIG. 10b

TEMPERATURE AND PRESSURE ACTIVATED PRESSURE RELIEVING SPARK PLUG

BACKGROUND OF THE INVENTION

Automatically actuated pressure relieving spark plugs have been described by Philips (U.S. Pat. No. 4,699,096) and Shifflette (U.S. Pat. No. 5,799,634). The Philips device consists of an unconventionally designed spark plug which incorporates one or more axial passages. These axial passages are outfitted with a tapered shoulder, which acts as a ball seat. A ball is forced against this seat by a helical spring which is oriented axially. Opposite the ball, the helical spring has a spring seat, which is often shown to be adjustable, via an adjusting screw. Excessive cylinder pressure, acting against the ball and its biasing spring, will unseat the ball such that pressure may be relieved upon reaching a predetermined (and adjustable) pressure. As the over-pressure is relieved, or otherwise abated (as at the end of the engine cycle stroke), the ball returns to the seated position by the biasing spring.

Manually induced keyseat style cylinder venting is also disclosed in U.S. Pat. No. 4,326,145 to Foster et. al. (Compression Relief Adapter). One design involves cutting a keyseat-style channel across the spark plug threads. This design develops a robust, pressure holding channel that terminates at a pressure transducer. This design communicates cylinder pressure upward, past the seal, but has no component that is engineered to automatically relieve cylinder pressure upon experiencing excessive temperature or pressure. As such, these designs cannot protect an engine against the deleterious effects of excessive pressure or temperature (or a combination of both) that may be encountered in a running engine.

Detonation will result in an engine at excessive values or combinations of the following: (1) static compression ratio, (2) inlet pressure or boost, (3) advanced ignition timing, (4) lean mixture, (5) low grade fuel. These will be referred to as engine parameters and causes of detonation. Detonation causes cylinder gas temperatures and pressures to greatly exceed normal levels. These are deleterious to engine components, hence unabated detonation will result in engine damage.

The Philips sparkplug reacts to excessive cylinder pressure, characteristic and indicative of detonation. But once the detonating cycle is completed, the vent port in the spark plug is reset, such that the detonating cycle can be repeated. This is, at best, a reactive strategy. Detonation is detected (by pressure which un-seats the ball from its seat) and perhaps abated to some degree by a release of cylinder pressure through the vent port. If the operator is audibly alerted to the venting event, he must then find the cause and correct it without much information available to assist him. One or more of the spark plugs were venting, but the number and location of the detonating cylinders has not been elucidated by the Philips design spark plug.

The design taught in U.S. Pat. No. 5,799,634 to Shifflette also vents in response to excessive cylinder pressure. This design, however, employs permanent deformation of a pressure containing structural member to initiate venting. Once venting is initiated, the spark plug continues to vent cylinder contents until it is repaired or replaced. This device includes multiple stages for the venting of gasses (a small passage, responsive to detonation) or for the venting of liquids (a large passage, responsive to hydrolock). As a detonating condition is developed within the engine from one of the five (5) causes, stated above, this device will respond by forming a small, permanent passage from the combustion chamber to the atmosphere.

The first of the five (5) stated causes of detonation is excessive static compression ratio. In an internal combustion engine, this ratio determines the final compressed pressure (and temperature) of the fuel air mixture. Near the end of the compression stroke, the charge is ignited by the spark. Cylinder pressures and temperatures then increase to effectively drive the piston downward, applying torque to the crankshaft. The proper combustion event is characterized by a flame front progressing through the unburned charge to oxidize the fuel at a finite rate. If the charge is ignited by the spark at excessively high pressures and temperatures the oxidation of the fuel air mixture will occur at an infinite rate. This is descriptive of an instantaneous combustion event and is termed detonation. Detonation in an internal combustion engine can produce instantaneous pressures in excess of 3000 psi, in contrast to the normal operating peak pressure of about 800 psi. Shock waves are generated and gas temperatures increase at a nearly infinite rate. The combustion chamber, valve faces, piston face and cylinder walls are considerably cooler than the cylinder gas temperature; hence the gas transfers heat to these members at a high rate. This heat transfer to the surrounding surfaces cools the gas, which causes it to contract and decrease in pressure. The thermal energy of the gas is irreversibly lost through heat transfer to the surrounding surfaces. Shock waves, impinging on the surrounding surfaces, lose much of the kinetic energy of the gas to those surfaces. The thermal and kinetic energy of the gas is lost to irreversibilities including heat transfer and sound generation. Engine performance will suffer from detonation. The fuel's chemical potential energy is released to the cylinder gas, which in turn, irreversibly loses the energy to the surroundings. There is little of the potential energy left over to drive the piston down. The detonation, shock wave generation and abatement and heat transfer occur over only a few degrees of crankshaft revolution; the depleted cylinder gas has no more energy to convert to work.

Detonation is detrimental to engine performance, but it is disastrous to engine components. High pressures can severely overload the structural members of the engine, including the piston, connecting rod, crankshaft, bearings, cylinder head and fasteners. High heat transfer rates will cause localized component temperatures which exceed the melting temperature. Mild detonation is often evidenced by aluminum specks on the insulator of the spark plug. This is caused by the aluminum piston having undergone surface vaporization at the face, and the vaporized aluminum having condensed and solidified on all internal engine surfaces. Since the spark plug insulator is white, the gray aluminum may be easily recognized. Severe detonation will erode a hole in the piston, beat the bearings out of the crankshaft and connecting rods, and break components from structural overload.

In newer engines, detonation has been controlled quite successfully with oxygen sensors and knock sensors. Recently manufactured, well-tuned passenger cars and light trucks seldom suffer from detonation. But a large market segment is not presently served: high performance and racing applications.

Many drag racing applications do not employ oxygen and knock sensors because the technology was not built into the selected powerplant. Aftermarket high-performance accessories can expose a critical weakness of another system which is not capable of preventing detonation. An example is the installation of an aftermarket turbo- or super-charger.

The increased air mass entering the cylinder during the intake stroke must be accompanied by proportionally more fuel. If the fuel system is incapable of providing adequate additional fuel, the engine will detonate. During high performance engine tuning, the engine variables are adjusted to produce maximum power. This performance maximum occurs just at the verge of detonation. Maximizing all of the first four (4) of the five (5) engine parameters, listed above, will result in maximum power. Exceeding the limit of any one of the above, or excessive combinations thereof, will result in detonation.

The high performance engine tuner must juggle the engine parameters to produce acceptable power, with a margin of error to the onset of detonation. Such sources of error could include: a drop in ambient temperature, a drop in ambient humidity, engine overheating or "hot-spotting", lack of fuel flow (e.g., fuel line restriction, undersized or poor performing fuel pump, exposed fuel pick-up), poor quality fuel, etc. During testing or racing conditions detonation is likely to occur. Sadly, under these conditions, engines are often destroyed in the blink of an eye. Once the engine is running, and large amounts of power are being generated, the tuner/operator has limited control over detonation, short of shutting down the engine. However, this can only occur if the detonation was audible and detected. Shutting the engine down will help to limit the amount of damage done by detonation. Upon subsequent, mandatory engine disassembly and inspection, the locations and causes of detonation may be investigated and a potential cause identified. This will be accompanied by parts replacement.

SUMMARY OF THE INVENTION

The permanently deforming pressure relieving spark of this invention is engineered to prevent detonation by reducing compression (ratio). When a cylinder develops excessive pressure or temperature, the spark plug will deform to create an air passage from inside the cylinder to the ambient air outside the cylinder. The air passage allows cylinder contents to escape, thus reducing the internal cylinder pressure. Given that one of the major causes of detonation is high static compression ratio, then a reduction of compression will suppress and eliminate detonation. A simple numerical example would be a 12:1 compression engine which, upon detonation and venting through the spark plug of this invention, would then drop to a lower compression ratio, for instance 10:1. If the charge is leaked (through the spark plug vent port) to atmosphere during the compression stroke, gas pressures and temperatures will not increase as rapidly. Thus, at the instant of charge ignition (by the spark), the temperature and pressure of the charge will be insufficiently high to initiate detonation.

The spark plug of this invention is activated whenever cylinder pressure or cylinder temperature, alone or in combination, exceed predetermined thresholds. Because the spark plug of the present invention is a direct descendant of ordinary, commercially available spark plugs, existing spark plugs may easily be adapted to exhibit pressure and temperature sensitive failure modes. The advantages of modifying existing spark plug designs are manifold. Spark plugs are designed with a number of characteristics which are important to application and operation; thread length ("reach"), seat (taper or flat with gasket), resistance (radio interference suppression) and heat range comprise just some of these design characteristics. The heat range for any particular spark plug design is principally empirically determined, and standardized experimental procedures can establish the relative (though not absolute) heat range of a spark plug design. Hence, while the spark plugs of different manufacturing origin will have differing heat ranges, and may have very different heat transfer characteristics, the failure mechanisms of this invention may be adapted to any spark plug through the selection of materials with known fusing or melting points and empirically determined pressure sealing characteristics.

The primary activation mechanisms of cylinder pressure and cylinder temperature occur in the ways described below. As they occur, alone or in combination, they cause the spark plug of this invention to permanently deform and form an air passage to vent cylinder contents, thus relieving internal cylinder components of further stresses, and providing a permanent indicator showing which cylinder incurred abnormal operating conditions.

Temperature Activation

The spark plug is located at the hottest point of the engine. This is because it is positioned at the site of the initiation of combustion. The insulator surrounding the center electrode must operate at temperatures between 1300° F. and 1800° F. Insulator temperatures which drop below this limit will "foul", with conductive deposits which cannot "burn off." Above the temperature range limit, the insulator becomes sufficiently hot to ignite the charge upon compression, and prior to the spark. This condition is known as pre-ignition and may very well result in detonation.

The spark plug body acts as a heat sink for the insulator. The rate of heat transfer from the insulator to this body will determine the operating temperature of the insulator. The cylinder head and coolant (if present) act as a heat sink for the spark plug body. Thus, in a normally operating engine, heat is transferred from the insulator, through the spark plug body, to the cylinder head, and finally to the coolant. Engine overheating may occur from many causes, but the coolant and cylinder head will be among the first to exhibit abnormally elevated temperatures. As the cylinder head temperature increases, the spark plug temperature will also increase. Hence the spark plug body is an accurate indicator of engine operating temperature and pending overheating.

A pressure relief port in the side wall of the spark plug body may be plugged with a sealing element which is affixed by a fusible metal (or solder, plastic or any other solid) having a known softening or melting point. Once the spark plug body adjacent to this fusible metal attains a predetermined temperature, the metal will soften or liquefy, freeing the scaling element and permitting it to be ejected by the pressure within the cylinder. This results in the opening of the pressure relief port in the spark plug.

Pressure Activation

Detonation and hydrostatic lock are leading causes of cylinder overpressure. Although they are very different phenomena, their results arc equally disastrous. High cylinder pressures will break, buckle or rupture engine components. The spark plug of this invention responds to cylinder overpressures by opening the vent port. The structural element acting to contain a scaling element and cylinder pressure must be designed to create an opening at a known maximum cylinder pressure limit.

As previously described, detonation is a high-temperature event. Hydrostatic lock, on the other hand, will occur at comparatively low temperatures. Liquid water must be below 100° C. (212° F.) at atmospheric pressure. The liquid in the cylinder will become a remarkable heat sink; cylinder and engine component temperatures will plummet as liquid water is ingested, making hydrolock a low engine temperature phenomenon.

Combination Pressure and Temperature Activation

Pressure and temperature within the cylinder are independent properties. Pressure and shock waves, if present, will pervade throughout the cylinder and combustion chamber. The upshot of this is that the pressure exerted upon the piston face is materially identical to the pressure to which the spark plug (and its weakened structure) is exposed. Detonation generates high rates of temperature increase in the cylinder gas; this high temperature effects a high heat transfer rate to all engine components exposed to the hot gas. Instantaneous component temperatures will rise rapidly, although not evenly, throughout the cylinder. Thermal diffusivity ($k/\rho c_p$), component mass and conductive boundary conditions (heat sinking ability) also determine a component's temperature change with time. During detonation the first component to exhibit marked temperature rise is the center electrode and internal insulator of the spark plug. The piston face will also show a sharp temperature rise because it has a high exposed surface for convective, conductive and radiative heat transfer, it is subject to high thermal diffusivity, it has a low component mass, and it is a modest heat sink, being able to diffuse heat only to cylinder walls, piston pin, and connecting rod. The spark plug, per se, will be among the first engine components to show marked temperature rise from detonation.

As metals and alloys are heated to near melting temperature a reduction in strength is nearly always observed. Put simply, high temperatures degrade the strength of metallic components. One likely class of metal alloys suitable for use as pressure containing structural elements of a spark plug is solders. Depending upon composition, solders exhibit either (1) melting points, (2) eutectics, or (3) liquidus—solidus temperatures. Regardless of the phenomenological phase change characteristics, solders exhibit decreased strength (tensile and shear) at temperatures elevated to nearly the "melt", temperature. Solders "soften", as the melt temperature is approached.

A detonating engine will increase the spark plug temperature, and dramatically increase the cylinder pressure. Either of these events, taken individually, might not be sufficient to cause the pressure containing structural element to deform and allow cylinder venting. However, the combination of high cylinder pressure along with a softening of the structural sealing element (nearing its melting point) will be sufficient to cause the spark plug to vent. The combined temperature and pressure effects, characteristic of detonation may be collectively employed to initiate spark plug venting.

Temperature Indicating and Monitoring

The body of a spark plug, which is in thermal contact with the insulator and the cylinder head, is a reliable indicator of engine temperature and operating condition. Because of this, much effort has been expended within the industry to place thermocouple probes on and within the spark plug. By and large, such efforts have been unsuccessful. It has proved difficult, or expensive, or both, to place and maintain thermocouples on a spark plug of an operating engine.

Several commercially available products will provide spark plug temperature monitoring at very little cost and effort. Temperature indicating strips, consisting of a number of temperature panels mounted to the body of a spark plug, will blacken or change color sequentially as temperature rises. A spark plug may be monitored for temperature simply by affixing such a temperature indicating strip to the appropriate location on the spark plug body. Temperature indicating paints may also be applied to the spark plug body in a temperature indicating matrix, such that maximum attained temperature is easily determined upon spark plug removal and/or inspection.

Maximum Temperature and Maximum Pressure Indicating and Monitoring

The spark plug of this invention can be used to indicate an engine's operating temperature and cylinder pressure. Once the values have been determined, the properly selected spark plug will stop detonation at its onset.

A sparkplug having "average",temperature and pressure failure thresholds is selected and installed, and the engine is operated. If the plug should vent, the maximum temperature reached should be recorded and the spark plug having the next highest temperature and pressure failure thresholds should be installed, and the engine operated. If the plug should vent, the preceding steps are repeated until a plug is used that does not vent when the engine is operated.

If the plug does not vent, the maximum temperature reached should be recorded and correlated to a "failure", pressure, based upon the spark plug's predetermined operating characteristics. One may then conclude that the cylinder pressure did not exceed the maximum failure pressure. The plug may then be replaced by the spark plug having the next lower temperature and pressure failure thresholds, and the engine again operated. This procedure should be repeated using spark plugs having lower failure thresholds until a plug is found to have failed during operation.

A comparison of the pressure and temperature parameters of a failed spark plug and the like parameters of the closest spark plug that did not fail will indicate a narrow range of pressure and temperature within which the engine normally operates. Thereafter, should detonation occur, the spark plug will vent, relieving detonation, and the tuner may then investigate the cause of detonation. In this manner the tuner may determine important engine operating conditions without the need for expensive or cumbersome instrumentation. The system described herein provides a very inexpensive methodology for deducing the maximum engine operating pressure and spark plug temperature. Once the proper spark plug has been selected for an application, that spark plug will provide ongoing protection against detonation, maximized protection against mild hydrolock, maximum pressure monitoring, and maximum temperature monitoring.

Accordingly, it is an object of the present invention to design a permanently deforming spark plug that will create an air vent to bleed off excess internal cylinder pressure upon the onset of predetermined conditions of temperature and pressure. It is a further object of the invention to design a spark plug that will protect internal engine components by relieving excess cylinder pressure whenever such pressure exceeds a predetermined maximum threshold. It is yet another object of the invention to provide a spark plug suitable for engine diagnosis that will provide an indication of maximum temperature reached during engine operation and will further indicate whether engine pressure exceeded a known threshold. It is still a further object of the invention to provide a permanently deforming spark plug whose failure modes are independent of parameters such as length of reach, type of seat, or operational temperature range. These and other objects of the invention will become evident through the following explanation of the invention.

BRIEF DESCRIPTION OF THE DRAWINGS

FIG. 9*a* shows the lower portion of a long reach, flat seat spark plug having a vertical, external keystyle channel in elevational view.

FIG. 9*b* shows a side, cross-sectional view of an intermediate washer for the spark plug of FIG. 9*a*.

FIG. 9*c* shows the intermediate washer of FIG. 9*b* in front, elevational view.

FIG. 10*a* shows the lower portion of a long reach, flat seat spark plug and washer in elevational view.

FIG. 10*b* shows the washer of FIG. 10*a* in elevational view.

DETAILED DESCRIPTION OF THE PREFERRED EMBODIMENTS

Figure 1:
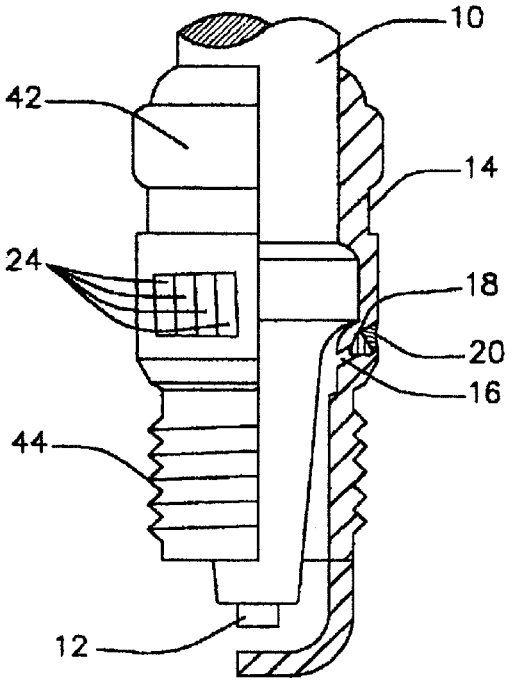
FIG. 1 shows the lower portion of a short reach, tapered seat spark plug in partial cross-sectional view.

FIG. 1 shows a short reach, tapered scat spark plug in partial cutaway view. Through hole 16 is located in the side wall of the spark plug body 14. The hole may be perpendicular or inclined to the spark plug axis, as shown. Through bore 16 is plugged with a pressure tight sealing element 18 which may withstand only certain predetermined pressures and temperatures. Insulator 10 houses center electrode 12. Through hole 16 forms a stepped, tapered vent port through the sidewall of spark plug body 14. Tapered sealing element 18 and temperature-deformable material 20, occlude vent port 16 to form a pressure seal. The temperature-deformable material may be comprised of solder, fusible metal or alloy, plastic, rubber, cure in place adhesive, such as RTV silicone or epoxy, fasteners such as screws, set screws, hollow set screws, rivets, or similar physical devices, a rupture disk, or any other suitable material. The mechanical properties of the above materials at elevated pressures and temperatures will be employed to produce the aforementioned pressure and temperature activated pressure relieving spark plug. Prior to the opening of the vent port 16 by expulsion of the sealing element(s) 18, 20, the spark plug functions identically to a conventional spark plug.

Temperature indicating (paints or strips) elements 24 may be asymmetrically disposed about the spark plug body 14 located between the hex flats 4 for installation and removal torque and the threads 44 for installation in the cylinder head. Temperature indicating paints lose color and gloss at a temperature which is characteristic for each paint. The paint stripes are initially of different colors. Alternatively, the paint stripes may be replaced with commercially available temperature indicating strips which are white until a characteristic temperature is reached, at which point, they turn black. These paint stripes or temperature indicating strips are arranged in an order of increasing temperature. After installation and operation in an internal combustion engine the temperature indicating elements will change color to indicate the maximum operating temperature oft he spark plug.

The pressure holding capacity of sealing elements 18 and 20 is a decreasing function of temperature, as the selected materials soften at elevated temperatures. After determination of the maximum attained temperature of the operating spark plug, the engine tuner may infer that the maximum cylinder pressure attained either did or did not exceed the failure threshold of the spark plug during engine operation by observing whether the vent port has been opened, indicating that pressure exceeded the threshold for the spark plug, or remained occluded.

Figure 2:
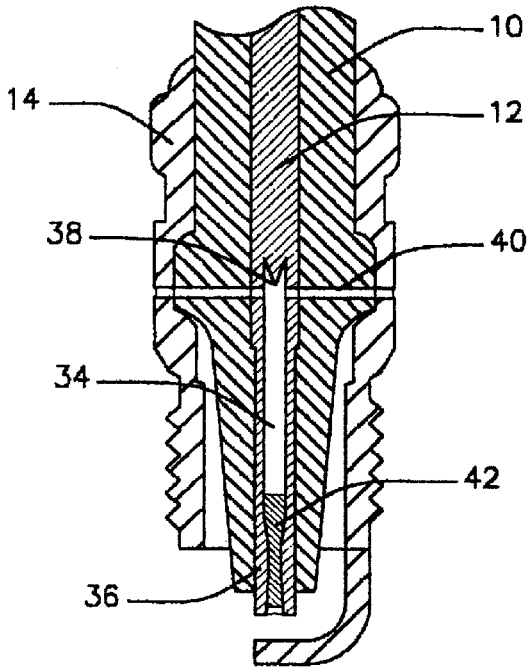
FIG. 2 shows the lower portion of short reach, tapered seat spark plug of this invention in a cross-sectional view.

FIG. 2 depicts a short reach, tapered seat spark plug in cross-sectional view. An axial vent passage 34 is shown through center electrode 12. The axial vent passage 34 is connected to radial vent passage 40, through insulator 10 and further through spark plug body 14. The vent passage 34 is occluded with a pressure seal provided by fusible metal 42. Upon the occurrence of excessive temperature or pressure, fusible metal 42 will melt or soften sufficiently that it may be expelled through the axial 34 and radial 40 vent passages allowing fluid exchange between cylinder and atmosphere. A converging-diverging nozzle 36 will promote supersonic compressible fluid flow in vent passage 34. Such supersonic flow will be characterized by shock waves which will be shaped by a generally conical shock reflecting surface 38. The gasdynamic interaction of compressible fluid through converging-diverging nozzle 36 and impinging upon shock reflecting surface 38 may promote standing shock waves which modulate compressible fluid flow through vent passage 34. This configuration will allow full flow through vent passages 34 and 40 during the compression stroke of engine, while restricting flow through vent passages 34 and 40 during combustion phase. Such a phenomenon would tend to reduce the static compression ratio of the engine, while minimizing lost engine power through loss of pressure and heat through vent passages 34 and 40 during combustion.

Figure 3:
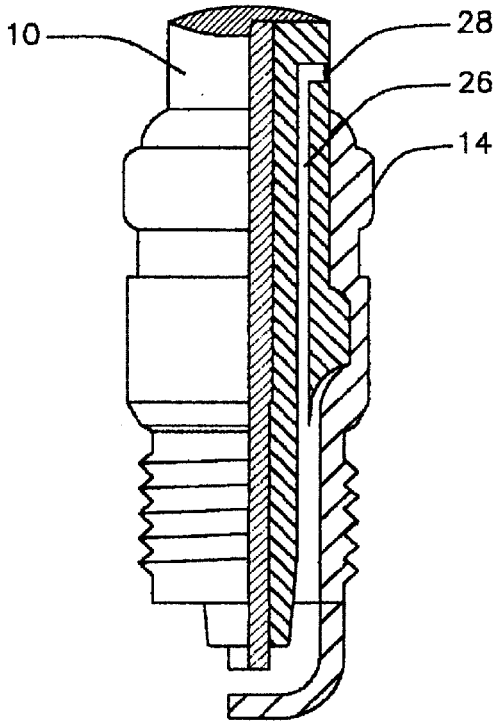
FIG. 3 shows the lower portion of a short reach, tapered seat spark plug in partial cross-sectional view.

FIG. 3 shows a short reach, tapered scat spark plug in partial cross-sectional view. An axial vent passage 26 is shown through the insulator 10. The axial vent passage 26 makes a 90 degree bend to become radially oriented above the spark plug body 14. A bore occlusion 28 provides a cylinder pressure holding seal. The bore occlusion 28 may be a sealing element such as solder, fusible metal, adhesive or polymer. Certain solders may be applied to ceramics to form a bond of known strength and temperature resistance. Alternatively, the bore occlusion may be ceramic and continuous with insulator material. The dimensions of the ceramic bore occlusion, coupled with the known mechanical properties of the ceramic, will determine the maximum pressure holding capability of the spark plug. As the maximum pressure is exceeded, the thin walled portion of ceramic remaining between the axial vent port 26 and the outer surface of the insulator will give way, effectively allowing the venting of cylinder gasses or liquids to atmosphere.

Figure 4:
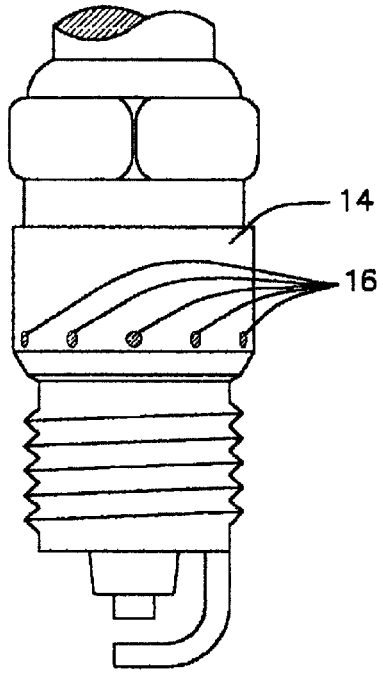
FIG. 4 shows the lower portion of a short reach, tapered scat a spark plug in elevational view.

FIG. 4 shows a short reach, taper seat spark plug in full perspective view. The spark plug body 14 is shown to have a plurality of through bores 16. Each through bore may be independently outfitted with individually selected sealing elements which may have different pressure holding characteristics. This embodiment allows for adaptive venting of the cylinder pressure, i.e., successive increases in cylinder pressure eject a successively greater number of sealing elements. By doing so, the pressure relieving spark plug is multi-staged, and can adapt the vent area to the cylinder pressure level present.

Figure 5:
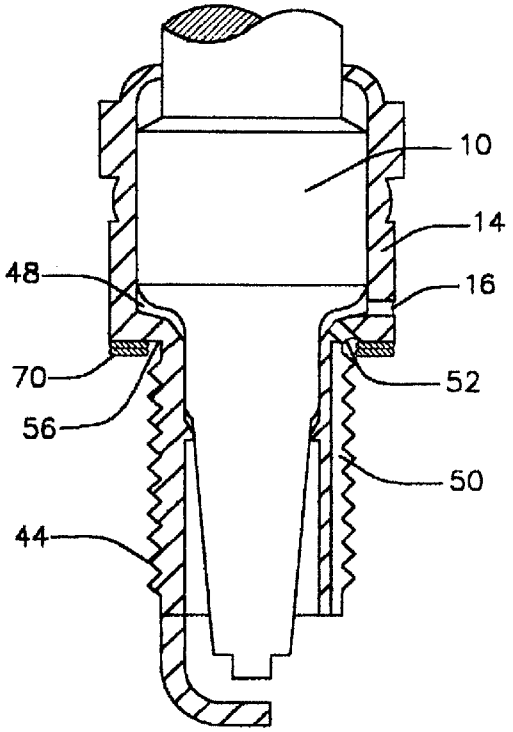
FIG. 5 shows the lower portion of a long reach, flat scat spark plug and washer of this invention in cross-sectional view.

FIG. 5 depicts a long reach, flat seat spark plug having an air passage along the external, threaded surface of the spark plug and a cavity 48 located between insulator 10 and spark plug body 14. A keyseat-style channel 50 is cut across the spark plug threads 44, terminating below flat sealing surface 56. A penetrating bore 52 containing a pressure seal may be made into the spark plug body cavity near the internal comer where the seal surface meets the threaded shank of the spark plug. The pressure seal will release to form an air passage when subjected to excessive pressures or temperatures.

Figure 6:
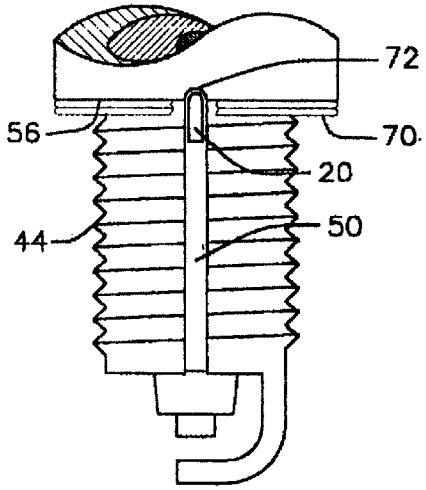
FIG. 6 shows the lowermost portion of a long reach, flat seat spark plug and washer in elevational view.

FIG. 6 shows the lower portion of a long reach spark plug having a keyseat-style channel 50 located axially across the threads of the spark plug. The keyseat-style channel 50 terminates above the sealing surface 56, and is shown to be a semi-circular seal breach 72. Disposed within the keyseat-style channel 50 and semi-circular seal breach 72 is fusible element 20, that may be metal, solder, polymer, or adhesive. Channel 50 provides a pathway for cylinder pressure to be transmitted upward to the seal. The channel is scaled at flat scat 56 with a crush ring 70 that serves as a seal between flat seat 56 and the cylinder head, although other methods of sealing the channel include a taper seat, such as is shown in FIG. 1. Keyseat-style channel 50 extends upward, past sealing surface 56, such that a seal is established by the placement of a permanently deforming clement such as fusible metal, solder, RTV silicone, epoxy, adhesive, or a similarly scaling deformable material 20. Under normal engine operating conditions, cylinder pressure is prevented from escaping. At or above spark plug operating temperature, excessive cylinder pressure will deform the sealing element to breach the seal, ejecting the element through semi-circular seal breach 72, and permitting the exchange of gasses or liquids from the cylinder to atmosphere. The passage formed upon breach of the seal will have a leak rate that is a function of keyseat depth, thread length, and open area and nozzle features such as tapering and radiusing.

Figure 7:
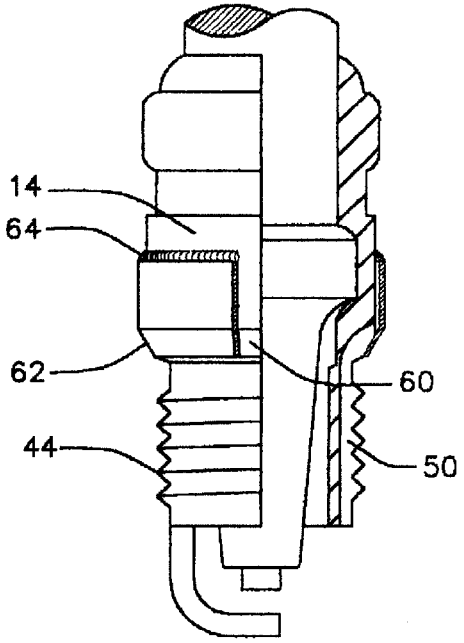
FIG. 7 shows the lower portion of a short reach, tapered scat spark plug having a pressure or rupture sleeve in partial cross-sectional view.

FIG. 7 shows a short reach, taper scat spark plug in partial cutaway view. A keyseat-style channel 50 is shown across the threads 44 and further across the tapered sealing surface 60. The channel extends upward to include a portion of the sealing surface 60 between the spark plug and the cylinder head, thereby breaching the seal. The seal is re-established by the incorporation of rigid cylindrical rupture sleeve 62 which transmits pressure upward, across the scaling surface 60. Pressure containing sleeve 62 contains cylinder pressure that has passed through keyseat-style channel 50 and across the breached tapered sealing surface. The upper end of the sleeve 62, may be sealed to the spark plug body using a weld 64 of solder, fusible alloy, adhesive or cure-in-place polymer. By employing a temperature dependent welding material, the seal can be designed to break upon experiencing predetermined pressure or temperature peaks, thus ensuring that automatic pressure and temperature activation will be attained.

A rupture disc may be used instead of a cylindrical sleeve. If used, it may take the familiar form of a thin circular disc affixed to a cylindrical opening.

Figure 8:
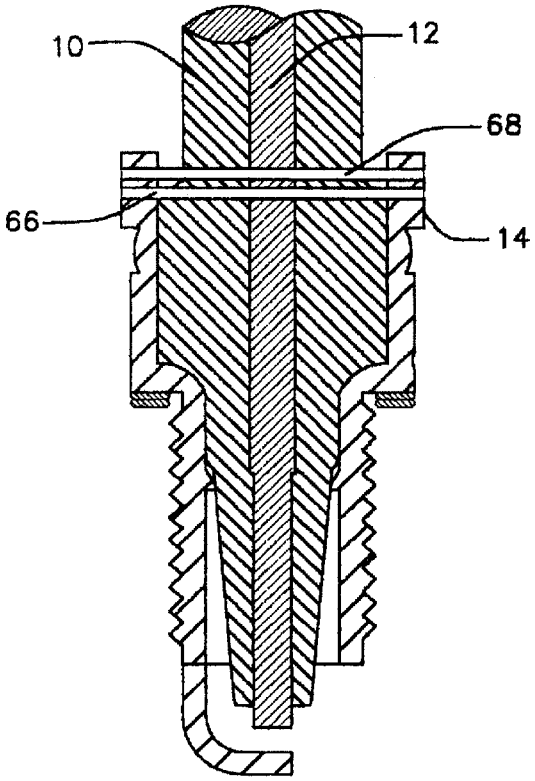
FIG. 8 shows the lower portion of a long reach, flat seat spark plug in cross-sectional view.

In FIG. 8, insulator 10 contains center electrode 12, and is axially secured within the spark plug body 14 by lower shear pin 66 to form a pressure seal between insulator 10 and spark plug body 14. A secondary, axially displaced, upper shear pin 68 is located slightly above shear pin 66. Under ordinary engine operating conditions, cylinder pressure is contained by the intimate contact between the outer surface of the insulator 10 and the inner surface of the spark plug body 14. Under abnormal engine operating conditions, which may include excessive cylinder pressure or temperature, lower shear pin 66 will shear or thermally weaken such that a slight, upward axial displacement of the insulator 10 will occur and a small cylinder leak will be created. The upper shear pin will limit the axial travel of the insulator 10 within the spark plug body 14. Clearance between insulator 10 and spark plug body 14 will permit limited venting of the cylinder contents. Upon further increase in cylinder pressure or temperature, the upper shear pin 68 will also fail in shear, permitting insulator 10 and center electrode 12 to be ejected from the spark plug body 14. Such ejection of the insulator 10 will present a large vent area for the expulsion of trapped cylinder gasses or liquids. This is particularly suitable for the expulsion of liquids under hydrostatic lock. The sparkplug will become inoperable. Replacement of insulator 10 along with shear pins 66 and 68 will once again render the spark plug operational.

FIG. 9*a* depicts a long reach, flat seat spark plug with a keyseat-style channel 50, cut across the spark plug threads 44, which terminates just below the sealing surface 56. In FIGS. 9*b* and *c*, an intermediate washer 54, such as a thick flat washer with a plug 20 occluding radial vent port 58 may be installed between the cylinder head and the spark plug. Radial vent port 58 may be occluded by a fusible element 20 such as solder, polymer, or adhesive. Cylinder pressure will pressurize the internal face of the intermediate washer 54. By selection of an appropriate material for die plug 20, an air vent passage will be formed whenever predetermined pressure or temperatures are encountered. The intermediate washer will reduce the spark plug thread engagement and, in some cases, may require the use of a longer reach spark plug to recover this lost engagement.

FIG. 10*a* shows the lower portion of a long reach, flat seat spark plug in full perspective view. A keyseat-style channel 50 is shown across the threads 44. The keyseat-style channel 50 terminates above the flat sealing surface 56 of the spark plug and forms a semi-circular seal breach 72. FIG. 10*b* shows an intermediate washer 54 with a seal breach mating surface 74 incorporated in the upper surface. Properly oriented assembly of the two (FIGS. 10*a* and 10*b*) will construct a cylindrically shaped vent port. This vent port may be occluded with a temperature responsive scaling element. Under normal engine operating conditions, cylinder pressure is prevented from escaping. When excessive temperatures or pressures are encountered, the sealing element is ejected through the cylindrical vent port formed of semi-circular seal breach 72 and mating surface 74, permitting the exchange of gasses and/or liquids from the cylinder to atmosphere.

Figure 11A:
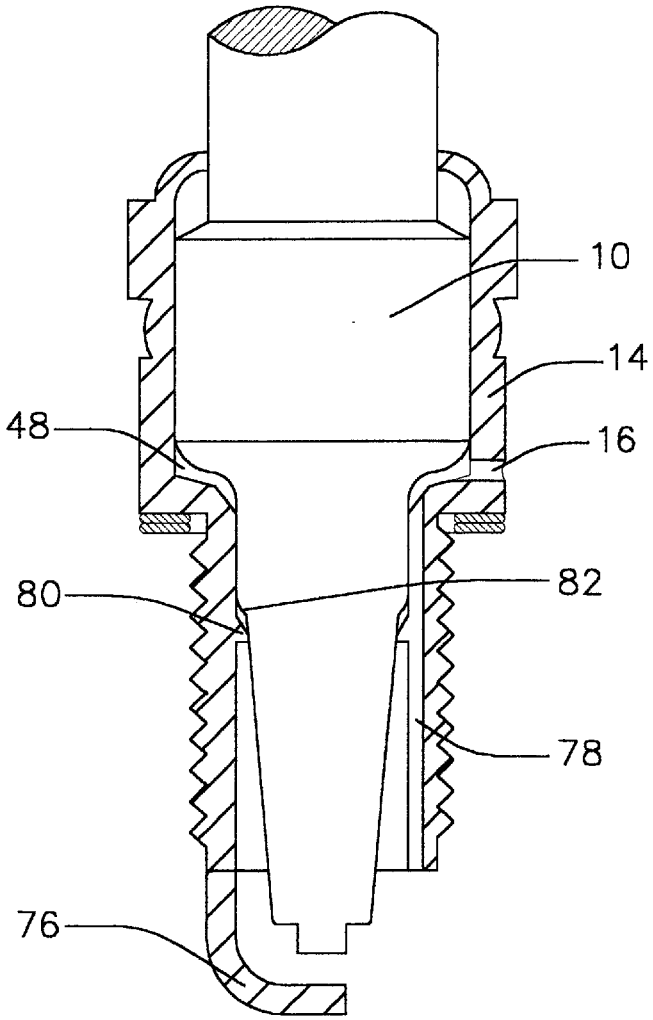
FIG. 11*a* shows a long reach, flat seat spark plug and washer in cross-sectional view.
Figure 11B:
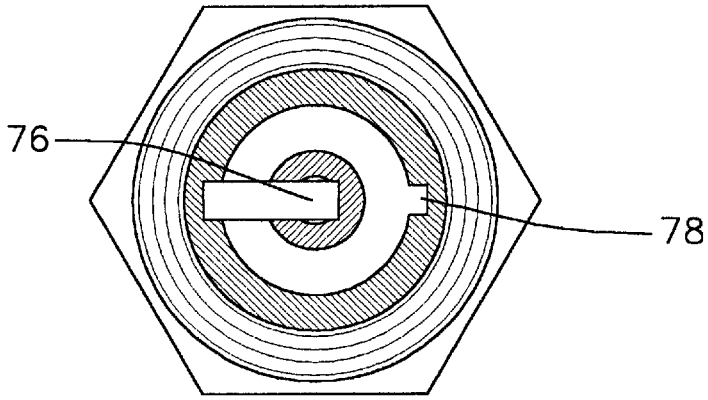
FIG. 11*b* shows the spark plug of FIG. 11*a* in a bottom view.

FIG. 11*a* shows a long reach, flat seat spark plug having an internal keyseat channel 78. This embodiment provides an alternative to those embodiments having an external keyseat through the threads, as depicted in FIGS. 5, 6, 7, 9, and 10. An internal keyseat configuration prevents the expulsion of hot combustion products from the combustion chamber via the unprotected internal threads of the cylinder head spark plug hole. In FIG. 11*b*, the threads of the spark plug hole arc not exposed to hot gasses because combustion chamber products are channeled through internal channel 78, located in the interior surface of spark plug body 14.

In FIG. 11*a*, the combustion chamber environment is brought into fluid communication with through hole 16 in spark plug body 14 by means of internal keyseat 78. A lower internal heat transfer region of insulator 10 interfaces with the internal face of the threaded region of spark plug body 14 and dictates the heat transfer between the two and hence the spark plug's "heat range." Shoulder 80 on spark plug body 14 forms a mechanical interface with mating shoulder 82 on a lower portion of insulator 10. Heat transfer characteristics of the interface remain largely unchanged by the presence of keyseat 78. Conventional "cold" spark plugs are often manufactured with the heat transfer interface being placed axially "low" in the spark plug body. However, in this embodiment of the spark plug of this invention, the heat transfer interface is distinct and separate from the pressure seal interface, and heat transfer is not appreciably affected by the presence of interior keyseat channel 78. The sealing aspect of this interface, which exists in conventional spark plugs, is defeated by the internal keyseat 78. As a result, combustion chamber pressure is transmitted through keyseat 78 to cavity 48 located between the internal face of the sparkplug body 14 and the insulator 10. Through bore 16 is similarly subjected to combustion chamber pressure. Occlusion of through bore 16 with an appropriate pressure and temperature activated pressure relief device will effect the desired cylinder venting on cylinder overpressure or overtemperature.

Persons of skill in the art will appreciate that the embodiments and descriptions shown and provided herein are illustrative of the concepts for a pressure and temperature activated pressure relieving spark plug, and should not be taken as limiting the scope and spirit of the invention.

What is claimed is:

1. A pressure relieving spark plug for installation in a cylinder of an internal combustion engine comprising:

a housing and a central portion;

said housing including a housing wall having an outer surface and an inner surface;

said outer surface including threaded means for securing said housing to said cylinder;

said inner surface of said housing wall extending around and contacting said central portion to form a pressure holding seal between said inner surface and said central portion;

said pressure holding seal being maintained by static axial force applied by at least one structural member;

said central portion being expelled to create a passage through said housing upon the onset of abnormal engine operating pressure sufficient to overcome said pressure holding seal and to deform said at least one structural member providing said static axial force.

2. A pressure relieving spark plug as recited in claim 1 wherein at least one said structural member is replaceable.

3. A pressure relieving spark plug as recited in claim 1 wherein at least one said structural member is a shear pin.

4. A pressure relieving spark plug as recited in claim 3 wherein said structural member is comprised of a plurality of shear pins;

each of said plurality of shear pins acting independently such that, upon the release of each said shear pin, said central portion is permitted incremental axial movement;

each said incremental axial movement creating an incrementally larger passage to permit incrementally greater fluid flow between said housing and said central portion.

5. A pressure relieving spark plug for installation in a cylinder of an internal combustion engine comprising:

a housing and a central portion, said central portion including an electrically conductive electrode and an electrical insulator, said housing including a housing wall having an outer surface and an inner surface, said outer surface including means for securing said housing to said cylinder, said inner surface of said housing wall extending around and contacting said central portion to form a pressure holding seal between said inner surface and said central portion, a passage through at least a portion of said spark plug, said passage having a first end and a second end, said first end of said passage terminating inside said cylinder, said second end of said passage terminating at the ambient atmosphere external to said spark plug, said passage being closed by at least one pressure scaling member during normal operation, at least a portion of said pressure scaling member becoming deformed to open said passage upon the occurrence of at least one of a plurality of predetermined abnormal engine operating conditions such that when said passage is open at least a portion of the contents of said cylinder may pass through said passage to said ambient atmosphere.

6. A pressure relieving spark plug as recited in claim 1 wherein said pressure sealing member is internal to and blocking said passage.

7. A pressure relieving spark plug as recited in claim 1 wherein said pressure scaling member is external to said passage.

8. A pressure relieving spark plug as recited in claim 7 wherein said pressure sealing member is an auxiliary structure.

9. A pressure relieving spark plug as recited in claim 7 wherein said pressure sealing member is contained within an auxiliary structure.

10. A pressure relieving spark plug as recited in claim 1 wherein said pressure sealing member is partly disposed in said passage and partly disposed in an auxiliary structure.

11. A pressure relieving spark plug as recited in claim 1 wherein said passage extends through said electrode.

12. A pressure relieving spark plug as recited in claim 1 wherein said passage extends through said insulator.

13. A pressure relieving spark plug as recited in claim 1 wherein at least two of said plurality of predetermined abnormal engine operating conditions are excessive cylinder pressure and excessive cylinder temperature.

14. A pressure relieving spark plug as recited in claim 13 wherein said spark plug is used to determine maximum engine operating temperature and maximum pressure developed in said cylinder during the operation of said engine, said spark plug further comprising a maximum temperature indicating means affixed to said spark plug and being positioned to experience and indicate the maximum temperature reached by said pressure sealing member during said operation of said engine, said pressure sealing member having a predetermined relationship between the pressure release strength of said pressure sealing member and the temperature of said pressure sealing member for a range of temperatures such that, for each measured temperature of said pressure sealing member within said range of temperatures, said pressure release strength of said pressure sealing member may be determined, whereby said maximum temperature may be observed and said pressure release strength for said pressure sealing member at said maximum temperature may be determined such that, if said pressure sealing member is intact, said maximum pressure developed in said cylinder at said maximum temperature will be lower than said predetermined pressure release strength of said pressure sealing member at said maximum temperature, and if said sealing member is not intact, said cylinder pressure reached at said maximum temperature is greater than said pressure release strength of said pressure scaling member at said maximum temperature.

15. A pressure relieving spark plug as recited in claim 1 wherein said pressure scaling member is replaceable.

* * * * *